US008408922B2

(12) United States Patent
Yamamoto

(10) Patent No.: US 8,408,922 B2
(45) Date of Patent: Apr. 2, 2013

(54) FIXATION STRUCTURE FOR FIXING L-SHAPED PLATE TERMINAL TO INSULATING MEMBER

(75) Inventor: Tetsuya Yamamoto, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/292,533

(22) Filed: Nov. 9, 2011

(65) Prior Publication Data

US 2012/0115340 A1 May 10, 2012

(30) Foreign Application Priority Data

Nov. 9, 2010 (JP) ..... 2010-250469

(51) Int. Cl.
*H01R 12/00* (2006.01)

(52) U.S. Cl. ..... 439/78; 439/949

(58) Field of Classification Search ..... 439/76.1, 439/76.2, 78, 733.1, 744, 949
See application file for complete search history.

(56) References Cited

U.S. PATENT DOCUMENTS 4,603,930 A * 8/1986 Ito ..... 439/78
4,685,753 A * 8/1987 Isshiki et al. ..... 439/74
6,220,876 B1 * 4/2001 Avila et al. ..... 439/76.2
7,927,111 B2 4/2011 Kita
2009/0163085 A1 6/2009 Makino et al.

FOREIGN PATENT DOCUMENTS

JP 2006-333583 A 12/2006
JP 2009-152108 A 7/2009
JP 2010-187458 A 8/2010

* cited by examiner

*Primary Examiner* — Khiem Nguyen
(74) *Attorney, Agent, or Firm* — Edwards Wildman Palmer LLP

(57) ABSTRACT

There is provide a fixation structure for fixing a L-shaped plate terminal to a terminal fixation portion of an insulating member, in which the L-shaped plate terminal can be fixed with its shape kept in a L-shape, which can improve positioning of the L-shaped plate terminal. There are provided engagement portions formed at an insert portion of the terminal fixation portion of the insulating member and at a board connection portion of the L-shaped plate terminal. When the board connection portion is inserted into the insert portion, the engagement portions of the insert portion and the board connection portion engage each other, thereby fixing the insert portion and the board connection portion to each other. As a result, the positioning of the board connection portion is improved, while preventing looseness in the fixation of the board connection portion.

4 Claims, 8 Drawing Sheets

FIXATION STRUCTURE FOR FIXING L-SHAPED PLATE TERMINAL TO INSULATING MEMBER

CROSS REFERENCE TO RELATED APPLICATION

The priority application Japanese Patent Application No. 2010-250469 upon which this patent application is based is hereby incorporated by reference.

TECHNICAL FIELD

The present invention relates to a fixation structure for fixing a L-shaped plate terminal to an insulating member. Specifically, the present invention relates to a fixation structure for fixing a L-shaped plate terminal having a board connection portion to a terminal fixation portion of an insulating member.

BACKGROUND OF THE INVENTION

There are provided electrical connection boxes mounted at various places in the motor vehicle. The electrical connection box, which is also referred to as a fuse block, a relay box or a junction block, is composed of a box body, an electric components mounted to the box body and a cover member covering for example an upper side of the box body. Examples of the electric components may include, for relatively small ones, a relay or a fuse, and for relatively large ones, a power distribution unit. The power distribution unit itself may be referred to as the electrical connection box.

Referring to FIG. 7, there is shown a power distribution unit 1. This power distribution unit 1 distributes electric power supplied from a power source such as a battery. The power distribution unit 1 includes a circuit board 2 formed for example into a rectangular shape, a plurality of relays 3 mounted on a surface of the circuit board 2, elements such as resistors, transistors and ICs (not shown) which are also mounted on the circuit board 2, a connector block 4 arranged at one side of the circuit board 2 and a power block 5 (or a fuse block) arranged at the other side of the circuit board 2 opposite to the connector block 4.

The circuit board 2 may be, for example, a metal core substrate. The metal core substrate includes a conductive metal core (e.g., a copper core) and thus is excellent in heat dissipation and in prevention of disturbance of electromagnetic wave.

As shown in FIG. 7 and FIG. 8, the connector block 4 includes a group of terminals 6 and a group of terminals 7, each group having a plurality of terminals made of conductive metal and an insulating member 8 made of insulating resin. For the group of terminals 6 and the group of terminals 7, a board connection portion (no reference sign applied) of each terminal is connected with a distribution circuit (not shown) of the circuit board 2. The insulating member 8 is screwed to the surface of the circuit board 2.

The power block 5 includes a plurality of L-shaped plate terminals made of conductive metal, a plurality of conductive bus bars 11 having a fork-shaped terminal 10 and an insulating member 12 made of insulating resin. The L-shaped plate terminal 9 is a plate-like terminal having a mating-terminal connection portion 13, a bent portion 14 and a board connection portion 15. The L-shaped plate terminal 9 is bent at the bent portion 14 and thus formed into a L-like shape as a whole.

The mating-terminal connection portion 13 is arranged parallel to the surface of the circuit board 2. That is, the mating-terminal connection portion 13 extends in a direction parallel to the circuit board. The board connection portion 15 is arranged perpendicular to the surface of the circuit board 2. That is, the board connection portion 15 extends in a direction perpendicular to the circuit board 2.

The mating-terminal connection portion 13 is provided with a fork-shaped terminal 16. An end of the board connection portion 15 is continuous with the mating-terminal connection portion 13 via the bent portion 14 and is arranged to connect with the distribution circuit (not shown) of the circuit board 2.

The fork-shaped terminal 16 of the L-shaped plate terminal 9 and the fork-shaped terminal 10 of the bus bar 11 are arranged to connect with a blade-like fuse terminal of a fuse (not shown). Specifically, the fork-shaped terminals 16 of the L-shaped plate terminals 9 are arranged to connect with a blade-like fuse terminal located at a downstream of the fuse, while the fork-shaped terminals 10 of the bus bars 11 are arranged to connect with a blade-like fuse terminal located at an upstream of the fuse.

The plurality of fork-shaped terminals 16 of the plurality of plate terminals 9 are arranged to align in a line in a transverse direction. Furthermore, the plurality of fork-shaped terminals 10 of the bus bars 11 are also arranged to align in a line in the transverse direction. Thus, the plurality of fork-shaped terminals 16 and the plurality of fork-shaped terminals 10 are arranged in laminate, forming layers.

The plurality of L-shaped plate terminals 9 and the bus bars 11 are fixed to the insulating member 12. Then, the insulating member 12 is moved down toward the surface of the circuit board 2 and screwed to the surface of the circuit board 2. When the insulating member 12 is moved down toward the surface of the circuit board 2, ends of the board connection portions are inserted into a predetermined location on the circuit board 2.

Examples of a technology related to a power distribution unit and an electrical connection box is disclosed in Documents 1 through 3 listed below.

The plurality of L-shaped plate terminals 9 shown in FIG. 8 are fixed to the insulating member 12 by using a press fitting or by using an insert molding. In a method using the press fitting, firstly a straight plate terminal 9 with the board connection portion 15 being unfolded is inserted into the insulating member 12, as shown with a dotted line in the drawing. As the insertion proceeds, a proximal end of the mating-terminal connection portion 13 is press fitted to the insulating member 12. Then, the board connection portion 15 is bent at a right angle at the bent portion 14 to form the plate terminal 9 into a L-shape, thereby completing the formation of the L-shaped plate terminal 9 and finishing the series of process.

Since the L-shaped plate terminal 9 has the fork-shaped terminal 16 formed at the mating-terminal connection portion 13, the L-shaped plate terminal 9 needs be inserted into the insulating member 12 from a side of the L-shaped plate terminal 9 adjacent to the board connection portion 15 in order to avoid the deformation of the fork-shaped terminal 16. Consequently, if the L-shaped plate terminals 9 are preliminary formed into the L-shape before the insertion, such L-shaped plate terminals 9 cannot be inserted into the insulating member 12. Thus, the plate terminals 9 need to be straight with the board connection portion 15 unfolded before the insertion. Therefore, there is required a step of bending the board connection portion 15 after it is press fitted into the insulating member 12. There is also a problem that, it is difficult to achieve the optimum positioning of the board connection portions 15 with respect to the circuit board 2 unless the bending of the board connection portion 15 is performed accurately using a separately provided equipment or facility.

Furthermore, if the ends of the board connection portions 15 are not positioned on the circuit board 2 in an optimum manner, the board connection portions 15 cannot be inserted into a predetermined location on the circuit board 2. Such failure will adversely affect the workability of the following processes. In addition, the use of the separately provided equipment or facility causes an increase in the cost. Especially, the cost will further increase to improve the accuracy of the bending.

The difficulty in the optimum positioning of the board connection portions 15 of the L-shaped plate terminals 9 with respect to the circuit board 2 is caused by the long distance between the location on the L-shaped plate terminal 9 press-fitted to the insulating member 12 and the location on the board connection portion 15 connected with the circuit board 2. Furthermore, the difficulty in the optimum positioning of the board connection portions 15 is also caused by the location of the bent portion being arranged between the location on the L-shaped plate terminal 9 press-fitted to the insulating member 12 and the location on the board connection portion 15 connected with the circuit board 2.

Furthermore, the method using the press fit of the L-shaped plate terminals 9 has another problem that, if the L-shaped plate terminals 9 are not press fitted firmly, there is produced a looseness in the fixation of the L-shaped plate terminals 9, which may also cause the difficulty in the optimum positioning of the L-shaped plate terminals 9 with respect to the circuit board 2.

Furthermore, the method of using an insert molding of the L-shaped plate terminals 9 has a problem that it requires a separately provided facility for the insert molding and requires a complex process in the insert molding.

RELATED ART DOCUMENT

Document 1: Japanese Patent Application Publication No. 2010-187458

Document 2: Japanese Patent Application Publication No. 2009-152108

Document 3: Japanese Patent Application Publication No. 2006-333583

SUMMARY OF THE INVENTION

In view of the above-described problems, an object of the present invention is to provide a fixation structure for fixing a L-shaped plate terminal to an insulating member in which the shape of the L-shaped plate terminal is kept in the L-shape during the fixation, which achieves the optimum positioning of the L-shaped plate terminals and which does not require the use of an insert molding.

In order to achieve the above-mentioned object, the present invention provides a fixation structure for fixing a L-shaped plate terminal to a terminal fixation portion of an insulating member, the L-shaped plate terminal having a plate-like board connection portion which is arranged to be connected with a circuit board and which extends in a direction perpendicular to the circuit board, the fixation structure having: an insert portion formed at the terminal fixation portion of the insulating member and extending in the direction perpendicular to the circuit board, wherein the board connection portion of the L-shaped plate terminal is inserted into the insert portion; and engagement portions provided at each of the insert portion and the board connection portion for positioning and fixation of the board connection portion.

According to the present invention described above, the insert portion is formed at the terminal fixation portion of the insulating member and extends in the direction perpendicular to the circuit board. Consequently, the L-shaped plate terminal which is formed into a L-shape before the insertion can be inserted into the insert portion and fixed to the terminal fixation portion of the insulating member without straightening the shape of the L-shaped plate terminal. Furthermore, when the board connection portion is inserted into the insert portion, the engagement portions of the insert portion and the board connection portion are engaged and fixed to each other. Consequently, looseness in the fixation of the board connection portion can be prevented as well as the positioning of the board connection portion can be improved. Furthermore, the optimum positioning of the board connection portion can also be achieved by arranging an connection end of the board connection portion, which is to be connected with the circuit board, to be located close to the engagement portions at which the board connection portion is fixed, and by arranging the engagement portions to be located closer to the connection end of the board connection portion than the bent portion of the board connection portion. In addition, the present invention can provide a simple fixation structure, does not require the use of insert molding and does not require the use of separate equipment or facility for bending the plate terminal for the fixation of the L-shaped plate terminal to the insulating member, thereby reducing the manufacturing cost.

Furthermore, according to the present invention, the engagement portions provided at the board connection portion are formed into a projection projecting from both sides of the board connection portion, respectively, while the engagement portions provided at the insert portion are formed into a U-like shape to surround the projections of the engagement portions of the board connection portion.

According to the present invention described above, when the board connection portion of the L-shaped plate terminal is inserted into the insert portion, the projections of the engagement portions of the board connection portion and the U-shaped portion of the engagement portions of the insert portion are engaged with each other. Thus, the board connection portion and the insert portion are fixed to each other, thereby preventing the looseness in the fixation of the board connection portion and improving the positioning of the board connection portion.

Furthermore, the L-shaped plate terminal includes a mating-terminal connection portion extending in a direction parallel to the circuit and continuous with the board connection portion via a bent portion. Furthermore, there are provided anchoring portions arranged respectively at a proximal end of the mating-terminal connection portion of the L-shaped plate terminal and at the terminal fixation portion of the insulating member to fix the proximal end of the mating-terminal connection portion of the L-shaped plate terminal to the terminal fixation portion of the insulating member.

According to the present invention described above, the proximal end of the mating-terminal connection portion of the L-shaped plate terminal can also be fixed to the terminal fixation portion of the insulating member at the anchoring portions. Consequently, the looseness in the fixation of the L-shaped plate terminal can be prevented in all of the up-down, right-left and front-back directions.

DESCRIPTION OF EXEMPLARY EMBODIMENTS

A fixation structure for fixing a L-shaped plate terminal to an insulating member according to the present invention is arranged so that the L-shaped plate terminal is fixed to a terminal fixation portion of the insulating member with its shape kept in the L-shape. There are provided engagement portions at an insert portion formed at the terminal fixation portion of the insulating member and at a board connection portion of the L-shaped plate terminal.

The following will describe exemplary embodiments of the present invention with reference to FIG. 1 through FIG. 6. The exemplary embodiments herein are not intended to limit the present invention.

Figure 6:
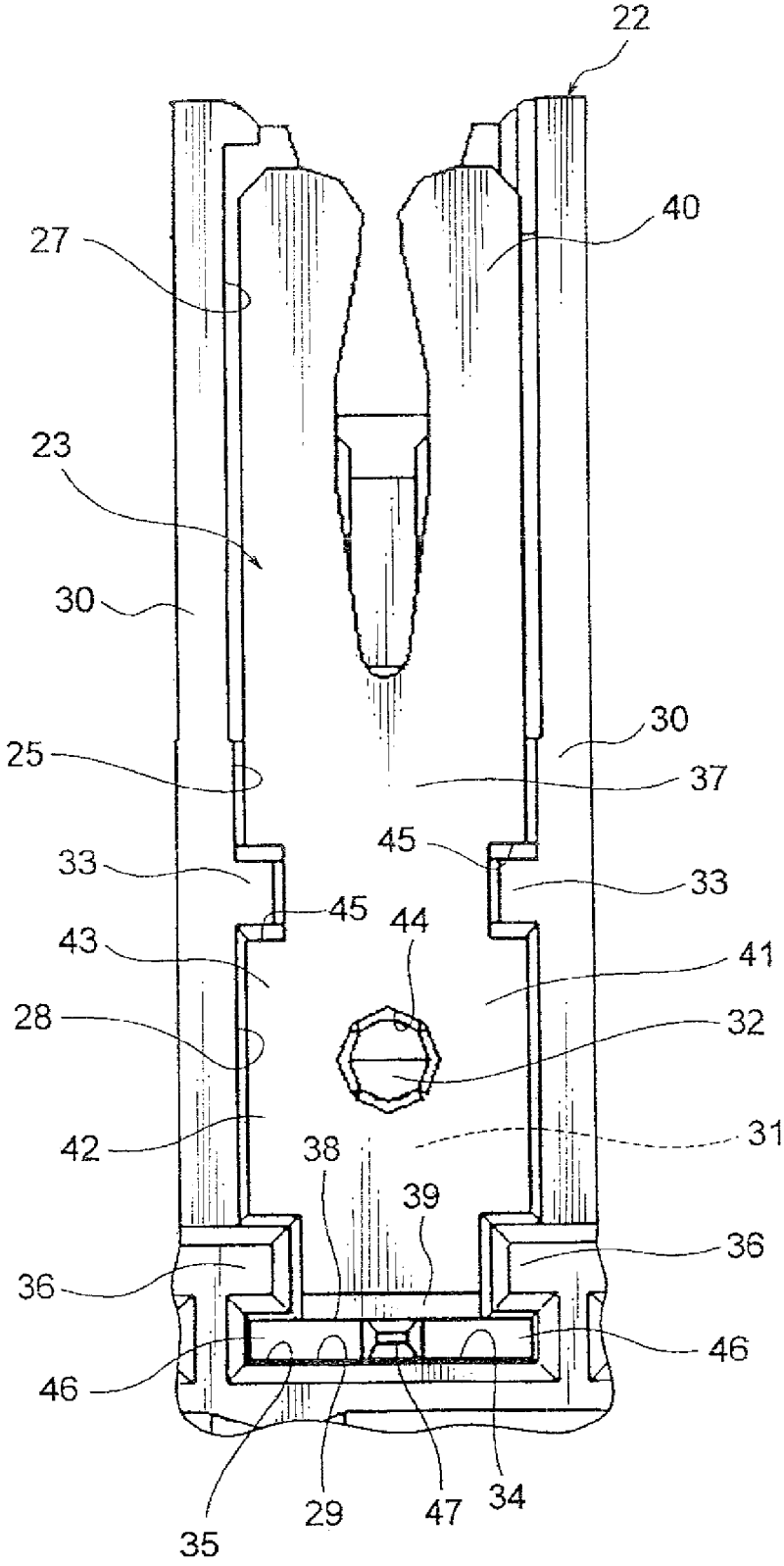
FIG. 6 is a top view showing a state in which the L-shaped plate terminal is fixed to the insulating member.

A fixation structure for fixing a L-shaped plate terminal to an insulating member according to the present invention is arranged to be applied to a power block of a power distribution unit (not shown, refer to FIG. 6 for example). In this embodiment, fork-shaped terminals are arranged in two layers, each layer including the fork-shaped terminals aligned in a line in a transverse direction. However, the present invention is not limited to this, and, for example, four layers may be employed instead of two layers.

Figure 1:
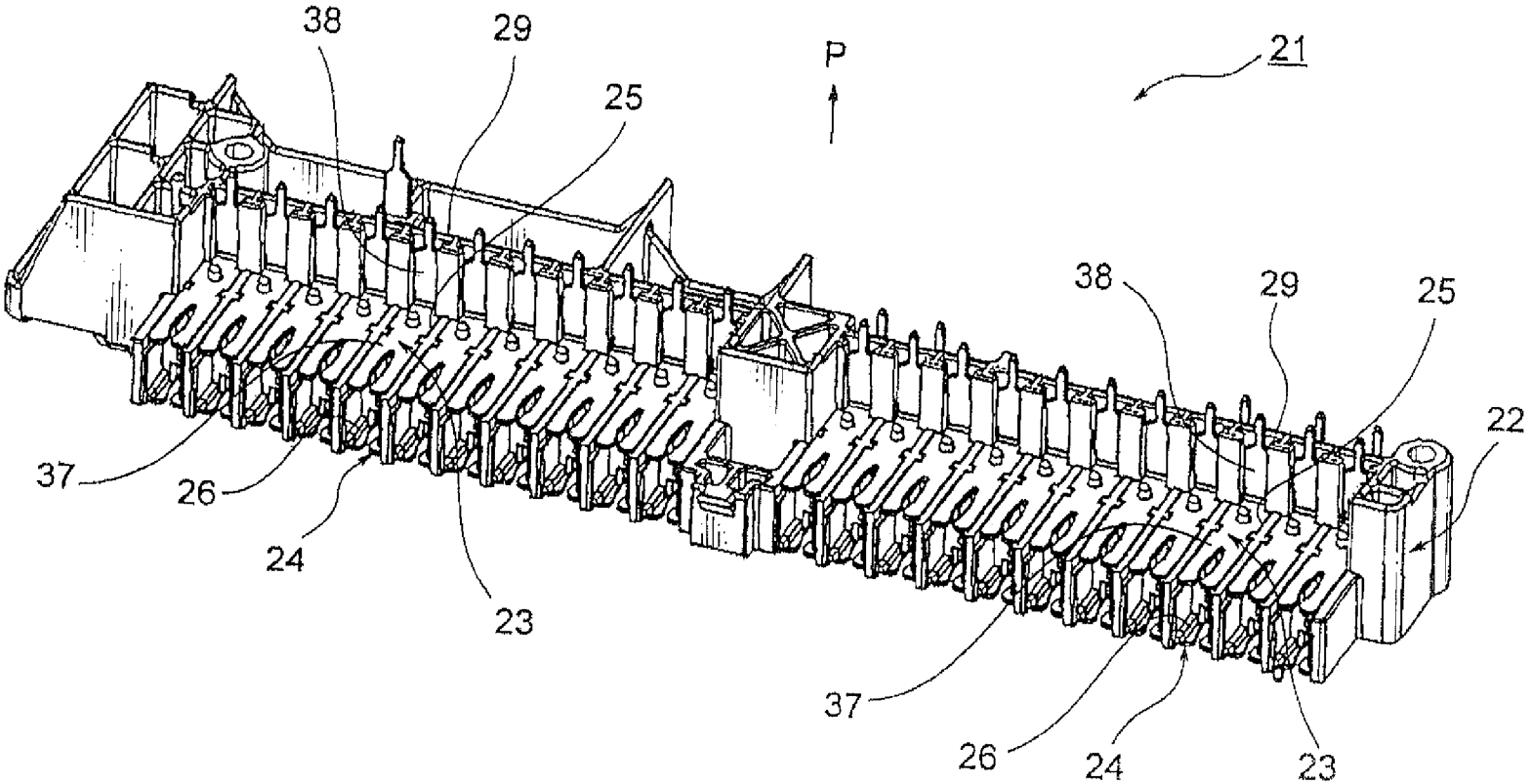
FIG. 1 is a perspective view of a power block seen from a side of L-shaped plate terminals, showing a fixation structure for fixing a L-shaped plate terminal to an insulating member according to one embodiment of the present invention.
Figure 2:
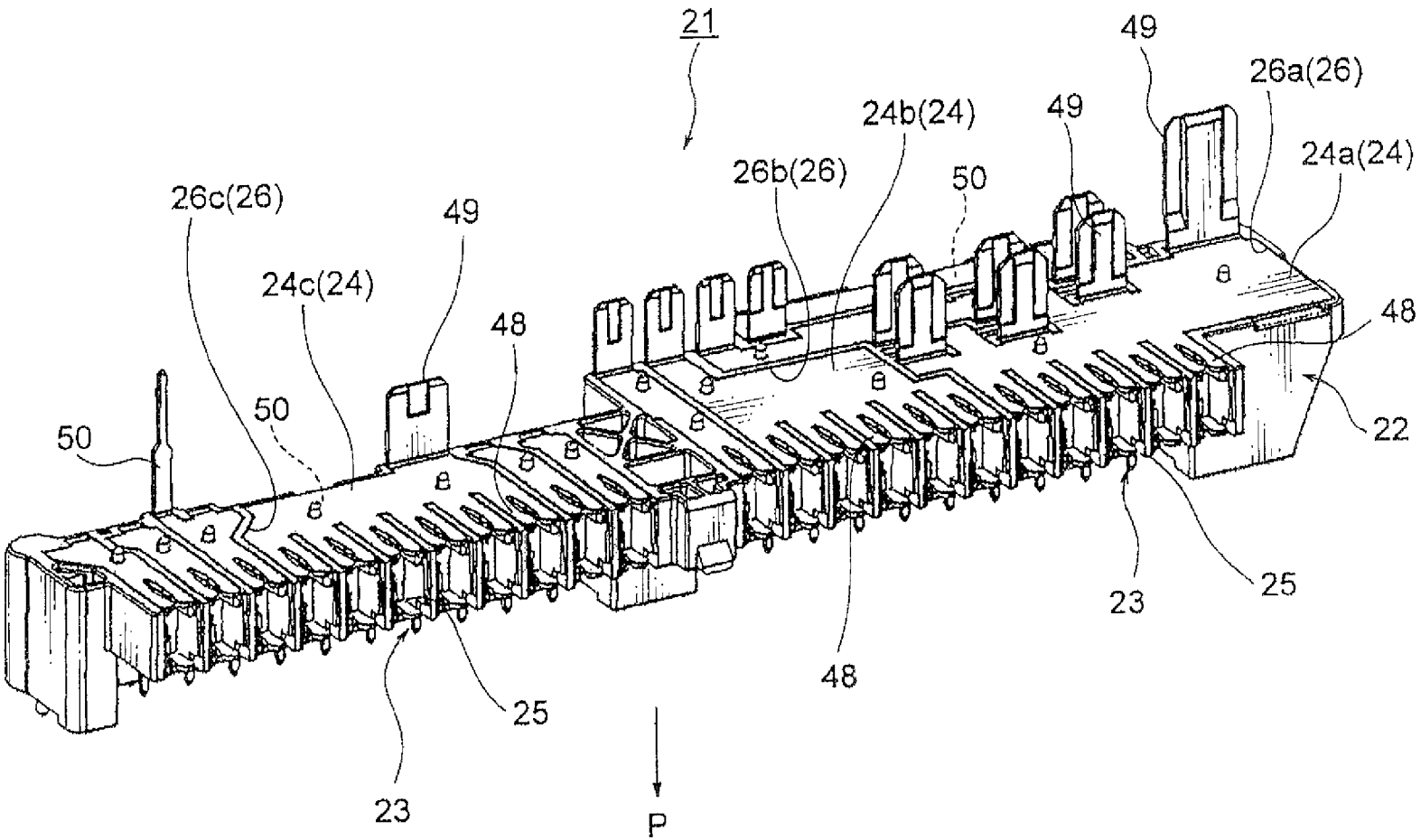
FIG. 2 is a perspective view of the power block seen from a side of bus bars.
Figure 7:
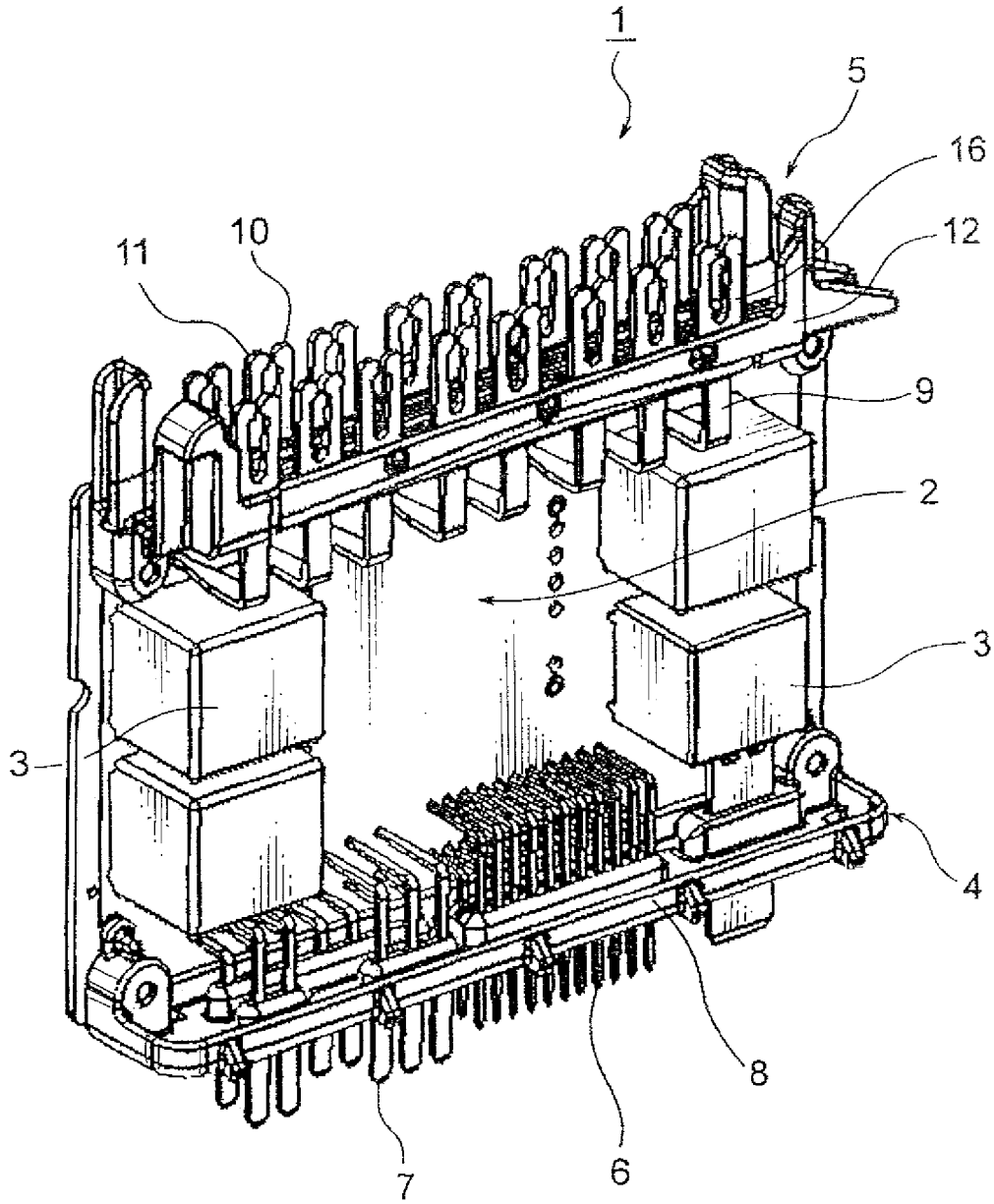
FIG. 7 PRIOR ART
FIG. 7 is a perspective view of a conventional power distribution unit.
Figure 8:
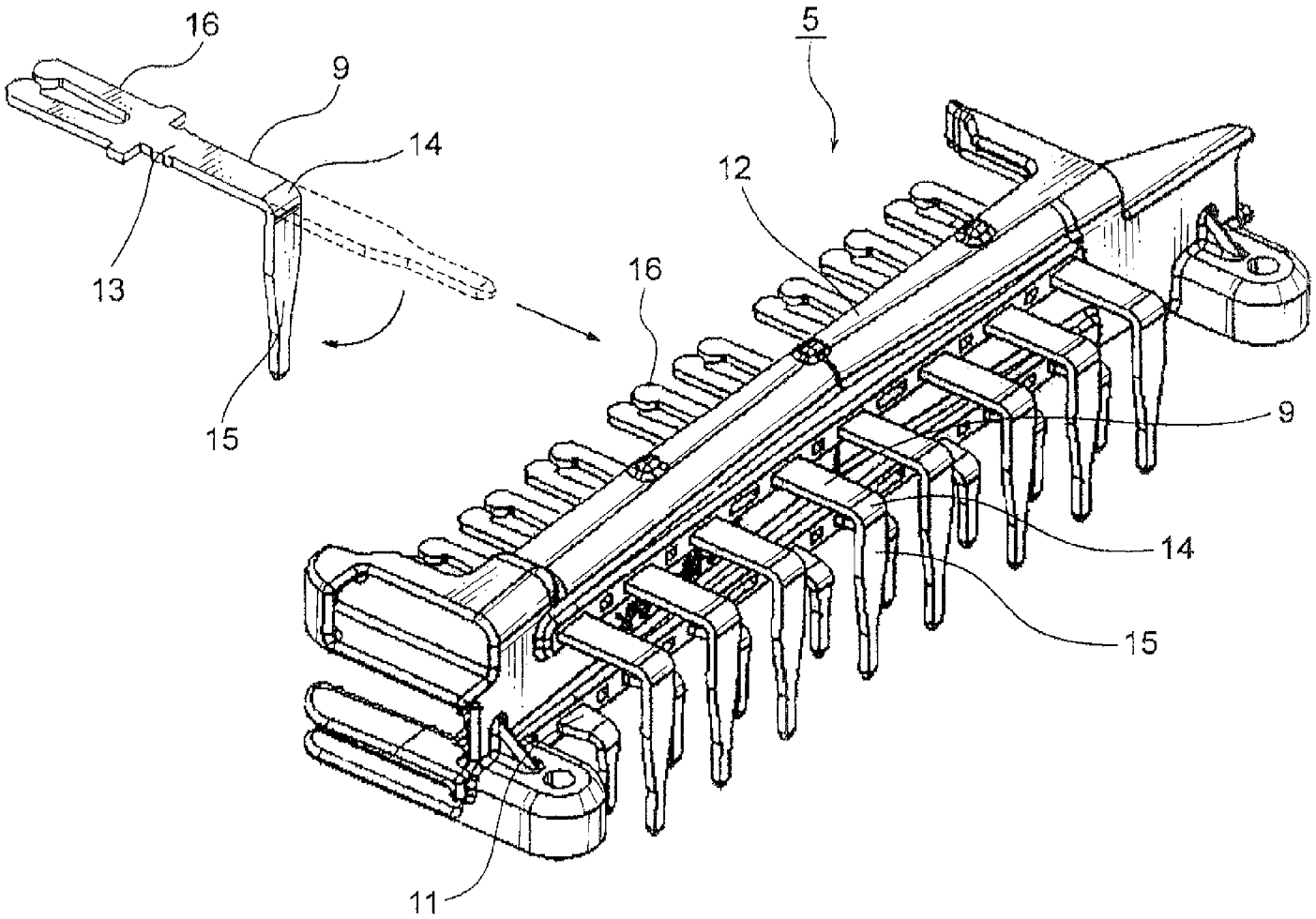
FIG. 8 PRIOR ART
FIG. 8 is an enlarged view of a power block shown in FIG. 7.

Referring to FIG. 1 and FIG. 2, there is shown a power block 21. This power block 21 is screwed to a surface or a back face of a circuit board (not shown, refer to FIG. 7 for example) and electrically connected with the circuit board. The power block 21 includes an insulating member made of resin, a plurality of L-shaped plate terminals 23 made of conductive metal and a plurality of bus bars 24 made of conductive metal.

In this example, the plurality of L-shaped plate terminals 23 is formed into the same shape, while the plurality of bus bars 24 is formed into different shapes. The to respective bus bars 24, since they are formed into different shapes, are indicated by references signs 24*a*, 24*b* and 24*c*, respectively.

The power block 21 is arranged so that the L-shaped plate terminals 23 are respectively inserted, mounted and fixed to a plurality of terminal fixation portions 25 formed at the insulating member 22. Furthermore, the power block 21 is also arranged so that the bus bars 24 are respectively mounted and fixed at a plurality of bus bar fixation portions 26 formed at the insulating member 22. Since the bus bars 24 are formed into different shapes as described above, the respective bus bar fixation portions 26 are indicated by references signs 26*a*, 26*b* and 26*c*, respectively.

Throughout the drawings, a P direction indicates a direction towards the circuit board (not shown). Thus, the power block 21 is arranged so that the plurality of terminal fixation portions 25 and the L-shaped plate terminals 23 fixed to the terminal fixation portions 25 face the circuit board.

Figure 3:
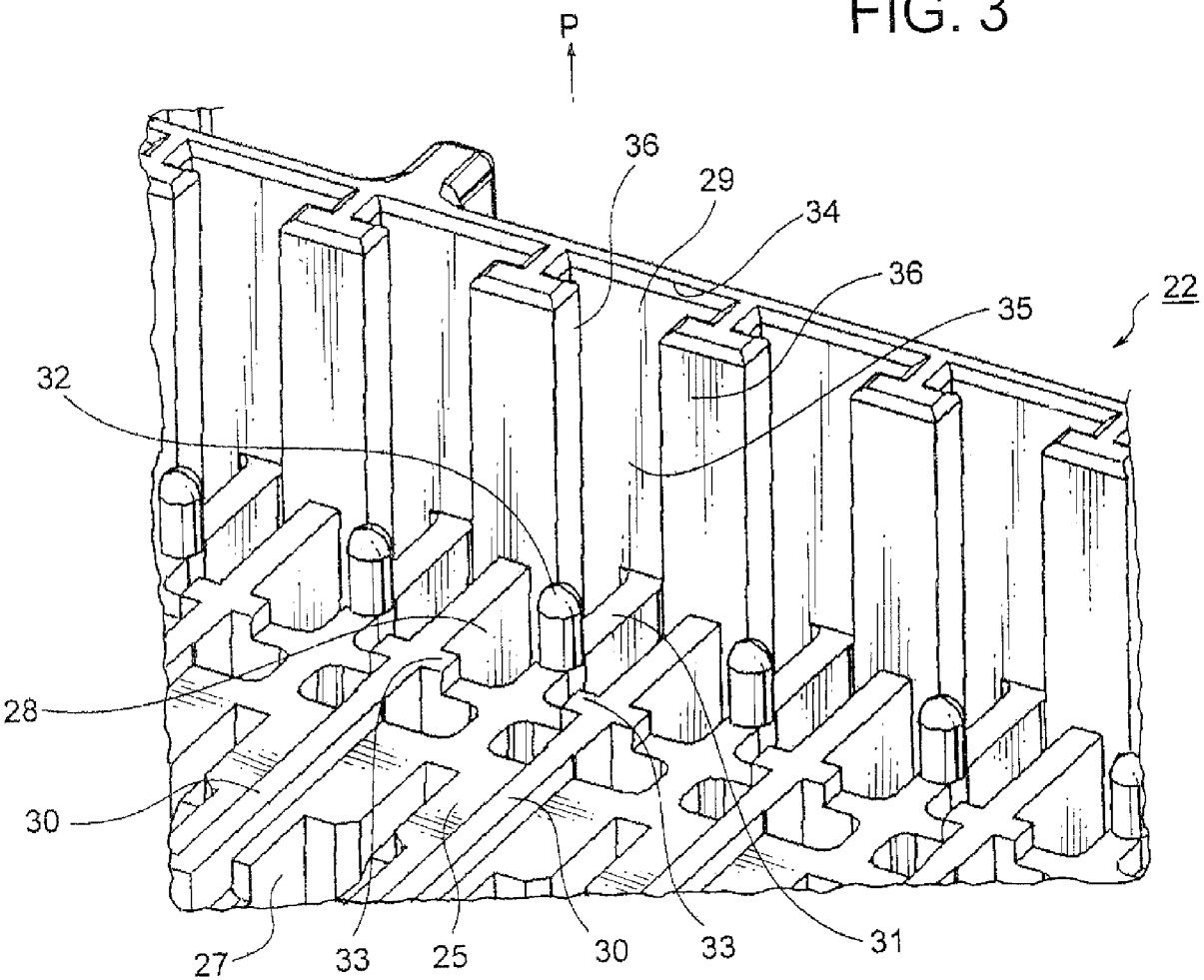
FIG. 3 is an enlarged view of a terminal fixation portion of the insulating member.

Referring to FIG. 1 through FIG. 3, the insulating member 22 shown is an injection molding product made of synthetic resin material, in which a split direction of an injection mold (not shown) is arranged parallel to the P direction. Thus, the insulating member 22 is designed in a shape suitable for forming a through hole or a bottomed-hole at the insulating member 22 along the P direction. The plurality of terminal fixation portions 25 of the insulating member 22 is arranged in a line in a transverse direction. All of the plurality of terminal fixation portions 25 is formed into the same shape.

Figure 5:
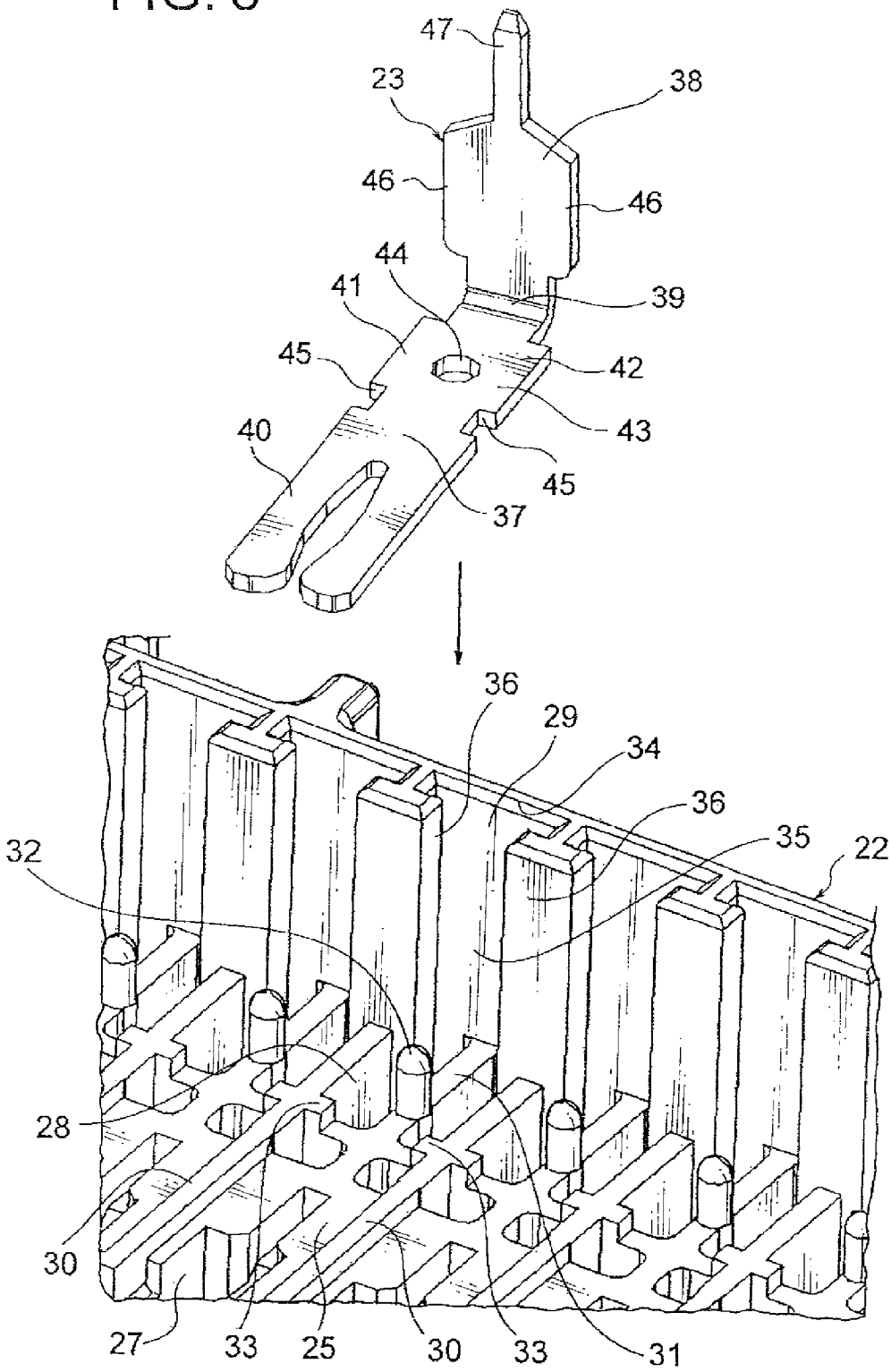
FIG. 5 is an illustration showing a state just before inserting the L-shaped plate terminal into the terminal fixation portion of the insulating member.

Referring to FIG. 3 and FIG. 5, the terminal fixation portion 25 includes a fuse connection portion 27, an anchoring portion 28 having one end continuous with the fuse connection portion 27, and an insert portion 29 extending perpendicularly from the other end of the anchoring portion 28. Thus, the terminal fixation portion 25 is formed into a L-like shape as shown in the drawings.

The fuse connection portion 27 and the anchoring portion 28 are arranged to extend in a direction parallel to the circuit board. The insert portion 29 is arranged to extend in a direction perpendicular to the circuit board.

The shape of the fuse connection portions 27 are arranged to connect with a blade-like fuse terminal located at a downstream of a fuse (not shown).

A pair of outer walls 30 are formed at both right and left sides of the fuse fixation portion 27 and the anchoring portion 28. The pair of outer walls 30 are spaced apart with a space substantially the same as the width of a later-described mating-terminal connection portion 37 of the L-shaped plate terminal 23, so that the pair of outer walls 30 serves to guide the mating-terminal connection portion 37.

The anchoring portion 28 is formed so as to mount and fix a proximal end 42 (or a mount plate portion 43) of the mating-terminal connection portion 37. In this exemplary embodiment, the anchoring portion 28 includes a flat mount portion 31 and an anchoring pin 32 projecting from the mount portion 31 in the direction perpendicular to the circuit board. The anchoring pin 32 anchors the proximal end 42 of the mating-terminal connection portion 37 by thermally crushing a tip end of the anchoring pin 32. In addition, the proximal end 42 of the mating-terminal connection portion 37 can easily and accurately placed onto the anchoring portion 28 by positioning protrusions 33 formed respectively at the pair of outer walls 30.

As described above, the insert portion 29 is arranged to extend perpendicularly from the other end of the anchoring portion 28 in the direction perpendicular to the circuit board. The insert portion 29 is arranged to receive a later-described board-side connection board 38. The insert portion 29 is provided with a terminal inlet 34, a terminal slide portion 35 and a pair of engagement portions 36. Thus, the insert portion 29 serves to position and fix the board connection portion 38 and prevents looseness in the fixation of the board-side connection board 38.

The terminal inlet 34 is an opening through which the board connection portion 38 is inserted. The terminal slide portion 35 and the pair of engagement portions 36 are arranged to extend from the terminal inlet 34 toward the other end of the anchoring portion 28. A back face of the board connection portion 38 inserted through the terminal inlet 34 slides on a flat surface of the terminal slide portion 35.

The pair of engagement portions 36 of the terminal fixation portion 25 is arranged at both right and left sides of the terminal slide portion 35. The pair of engagement portions 36 is arranged such that a space between free ends of the respective engagement portions 36 matches the width of a later-described bent portion 39 of the L-shaped plate terminal 23, so that the bent portion 39 can pass though the space between the free ends of the engagement portions 36.

As shown in FIG. 6, each of the engagement portions 36 partially includes the terminal slide portion 35, thus the engagement portions 36 are formed into a U-shape so as to surround a later-described engagement portions 46 of the board connection portion 38 of the L-shaped plate terminal 23.

Since the engagement portions 36 are arranged to surround the engagement portions 46 of the board connection portion 38 of the L-shaped plate terminal 23, respectively, the engagement portions 36 can effectively position and fix the board connection portion 38 while preventing the looseness in the fixation of the board connection portion 38. Furthermore, the pair of engagement portions 36 serves to guide the board connection portion 38 inserted into the insert portion 29.

Furthermore, the shape of the engagement portions 36 are also arranged to fix the engagement portions 46 of the board connection portion 38 after the insertion of the board connection portion 38.

Figure 4:
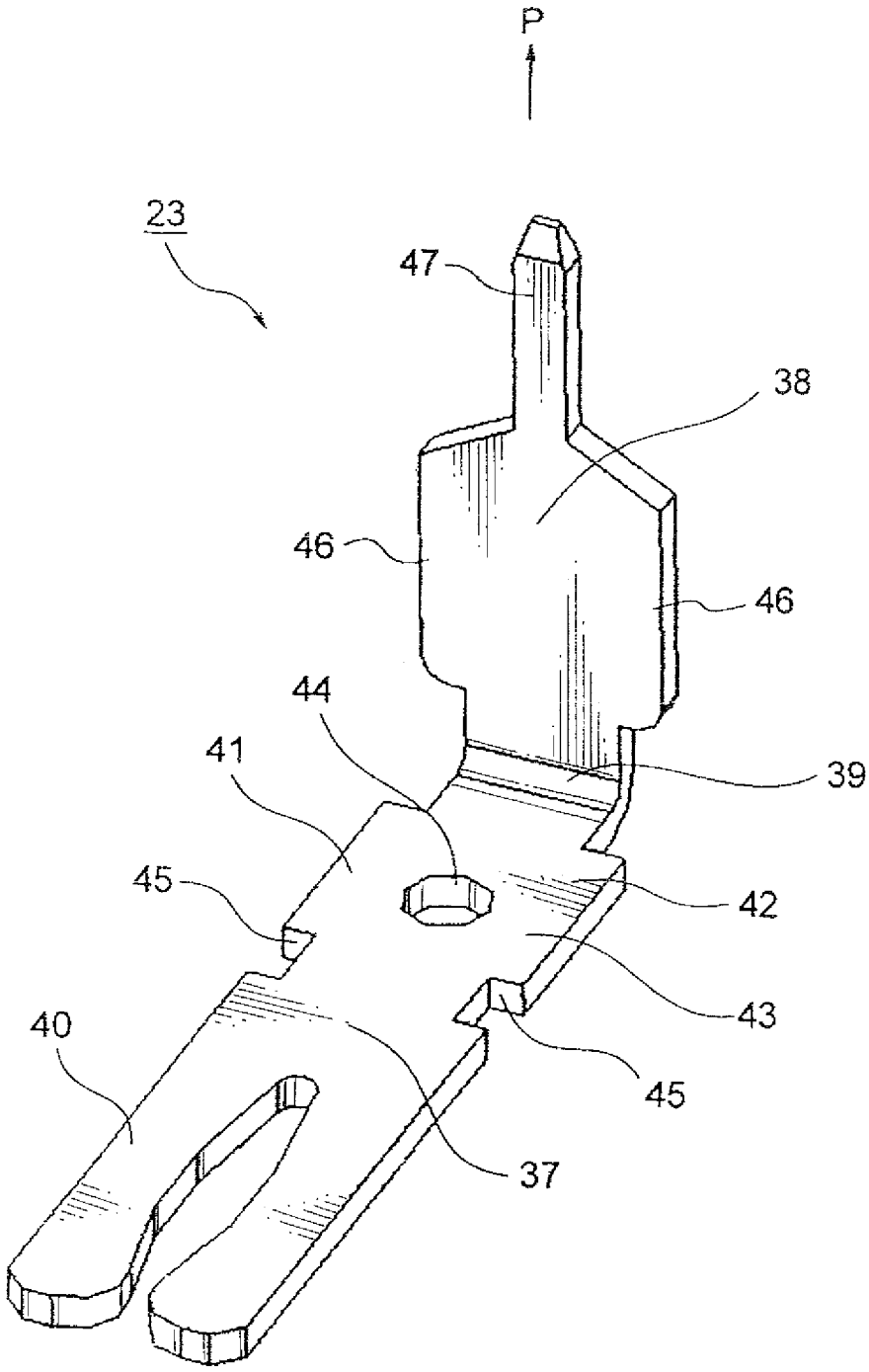
FIG. 4 is an enlarged view of the L-shaped plate terminal.

Referring to FIG. 4 and FIG. 5, the L-shaped plate terminal 23 is formed by pressing a conductive metal plate which is then bent at the bent portion 39. The L-shaped plate terminal 23 is provided with the mating-terminal connection portion 37 extending in the direction parallel to the circuit board, the board connection portion 38 extending in the direction perpendicular to the circuit board, and the bent portion 39 arranged between the mating-terminal connection portion 37 and the board connection portion 38.

The mating-terminal connection portion 37 is provided with a fork-shaped terminal 40 and an anchoring portion 41 having one end continuous with the fork-shaped terminal 40. The shape of the fork-shaped terminals 40 is arranged to connect with the blade-like fuse terminal located at the downstream of the fuse (not shown). The fork-shaped terminal 40 is formed into a well-known shape. The anchoring portion 41 corresponds to a proximal end 42 of the mating-terminal connection portion 37 and is continuous with the bent portion 39. The proximal end 42 is located at an end of the mating-terminal connection portion 37 opposite to the fork-shaped terminal 40.

The anchoring portion 41 is provided with the flat mount plate portion 43 to be mounted on the mount portion 31 of the terminal fixation portion 25, an anchoring pin insert hole 44 through which the anchoring pin 32 of the terminal fixation portion 25 is inserted, and a pair of positioning recesses 45 through which the pair of positioning protrusions 33 of the terminal fixation portion 25 is passed respectively.

The bent portion 39 is formed by folding and is formed narrower than the width of the anchoring portion 41.

The board connection portion 38 is provided with the pair of engagement portions 46. The respective engagement portions 46 have a projecting portion projecting from both right and left sides of the board connection portion 38. In this embodiment, such projecting portion of the engagement portion 46 is formed into a trapezoidal shape. By forming the engagement portions 46 into the trapezoidal shape, the board connection portion 38 can be inserted smoothly along an inclined face of the trapezoidal shape.

The pair of engagement portions 46, when inserted into the pair of engagement portions 36 of the terminal fixation portion 25 (or the insert portion 29), positions and to fixes the board connection portion 38, thereby preventing the looseness in the fixation of the board connection portion 38.

The board connection portion 38 is provided with a circuit connection end 47 formed at an end of the board connection portion 38 to be connected with the distribution circuit of the circuit board.

Referring back to FIG. 2, the plurality of bus bar fixation portions 26 of the insulating member 22 is arranged in a manner similar to the terminal fixation portion 25. Thus, the respective bus bar fixation portions 26 include a fuse connection portion, an anchoring portion having one end continuous with the fuse connection portion, and an insert portion extending perpendicularly from the other end of the anchoring portion. In addition, the insert portion is arranged to receive a later-described board connection portions 50 of the bus bars 24 (refer to FIG. 1).

The bus bars 24 include one or more fork-shaped terminals 48. Furthermore, the bus bars 24 are provided with connection tabs 49 and the board connection portions 50 and are fixed to the bus bar fixation portions 26. The shape of the fork-shaped terminals 48 is arranged to connect with a blade-like fuse terminal located at an upstream of a fuse (not shown).

The following will describe the fixation of the L-shape plate terminal 23 to the terminal fixation portion 25 with reference to FIG. 5. Firstly, the L-shape plate terminal 23 placed above the terminal fixation portion 25 is moved downward, and a portion of the L-shaped plate terminal 23 adjacent the bent portion 39 is inserted into the insert portion 29 of the terminal fixation portion 25 from the terminal inlet 34. Then, the bent portion 39 adjacent to the mating-terminal connection portion 37 is passed through a predetermined portion of the insert portion 29, specifically through the free end portions of the engagement portions 36 of the insert portion 29.

As the L-shaped plate terminal 23 is inserted further, the board connection portion 38 of the L-shaped plate terminal 23 passes through the insert portion 29. As shown in FIG. 6, when the board connection portion 38 is inserted through the insert portion 29, the pair of engagement portions 46 of the board connection portion 38 engages with the pair of engagement portions 36 of the insert portion 29. Then, after completing the insertion, the pair of engagement portions 36 and the pair of engagement portions 46 are engaged and fixed to each other.

When the pair of engagement portions 36 and the pair of engagement portions 46 are fixed to each other, stable positioning of the pin-like circuit connection end 47 of the board connection portion 38 is achieved.

Furthermore, after the insertion has completed, the mating-terminal connection portion 37 of the L-shaped plate terminal 23 is mounted onto the terminal fixation portion 25. Specifically, the anchoring portion 41 of the mating-terminal connection portion 37 is mounted onto the anchoring portion 28 of the terminal fixation portion 25, in which the mating-terminal connection portion 37 is guided by the pair of outer walls 30 of the terminal fixation portion 25.

Finally, the anchoring pin 32 of the terminal fixation portion 25 projecting from the anchoring pin insert portion 44 of the anchoring portion 41 is thermally crushed using a thermal swaging device (not shown), thereby fixing the anchoring portion 28 and the anchoring portion 41 to each other. Consequently, the L-shaped plate terminal 23 is firmly fixed in all of the up-down, right-left and front-back directions, thereby preventing the looseness in the fixation of the L-shaped plate terminal 23. Therefore, the circuit connection end 47 of the board connection portion 38 can be positioned even more stably.

In addition, during the above-described fixation process of the L-shaped plate terminal 23, the mating-terminal connection portion 37 of the L-shaped plate terminal 23 is not inserted into the insert portion 29 of the terminal fixation portion 25. Thus, the fork-shaped terminal 40 can be prevented from being deformed.

As explained above, according to the present invention, there is provided the insert portion 29 formed at the terminal fixation portion 25 of the insulating member 22 through which the board connection portion 38 of the L-shaped plate terminal 23 is passed. Since the insert portion 29 is arranged to extend in the direction perpendicular to the circuit board, the L-shaped plate terminal 23 can be fixed to the terminal fixation portion 25 with the shape of the L-shaped plate terminal 23 kept in the L-shape.

Furthermore, according to the present invention, the insert portion 29 and the board connection portion 38 are provide with the engagement portions 36 and 46, respectively. Thus, when the board connection portion 38 is inserted into the insert portion 29, the engagement portions 36, 46 are engaged each other and fixed to each other, thereby preventing the looseness in the fixation of the board connection portion 38 while achieving the optimum positioning of the board connection portion 38, especially of the circuit connection end 47.

More specifically, by inserting the board connection portion 38 into the insert portion 29, the U-shaped portions of the engagement portions 36 and the projecting portions of the engagement portions 46 engage each other. Thus, the board connection portion 38 and the insert portion 29 are fixed with respect to each other, thereby preventing the looseness in the fixation of the board connection portion 38. Thus, the board connection portion 38 can be positioned in an optimum manner.

Furthermore, according to the present invention, the circuit connection end 47 of the board connection portion 38 is located close to the engaged portion of the engagement portions 36, 46. In addition, the circuit connection end 47 is located closer to the engaged portion of the engagement portions 36, 46 than the bent portion 39. Therefore, the circuit connection end 47 can be fixed more securely, achieving the optimum positioning of the circuit connection end 47.

Furthermore, as shown in FIG. 2, the bus bars 24 are provided with the board connection portions 50 and are formed into the L-shape. Thus, the bus bars 24 are also L-shaped plate terminals to which the present invention can be applied.

In the embodiments described above, the L-shaped plate terminals 23 are arranged at a side adjacent to the circuit board. However, the bus bars 24 may be arranged at the side adjacent to the circuit board.

The embodiments described herein are only representative embodiments and are not intended to limit the present invention. It will be understood that various modifications to the embodiments may be made without departing the scope of the present invention.

LIST OF REFERENCE SIGNS

21 power block
22 insulating member
23 L-shaped plate terminal
24 bus bar
25 terminal fixation portion
26 bus bar fixation portion
27 fuse connection portion
28 anchoring portion
29 insert portion
30 outer wall
31 mount portion
32 anchoring pin
33 positioning protrusion
34 terminal inlet
35 terminal slide portion
36 engagement portion
37 mating-terminal connection portion
38 board connection portion
39 bent portion
40 fork-shaped terminal
41 anchoring portion
42 proximal end
43 mount plate portion
44 anchoring pin insert hole
45 positioning recess
46 engagement portion
47 circuit connection end
48 fork-shaped terminal
49 tab
50 board connection portion

What is claimed is:

1. A fixation structure for fixing a L-shaped plate terminal to a terminal fixation portion of an insulating member, the L-shaped plate terminal having a plate-like board connection portion which is arranged to be connected with a circuit board and which extends in a direction perpendicular to the circuit board, the fixation structure comprising:

an insert portion formed at the terminal fixation portion of the insulating member and extending in the direction perpendicular to the circuit board, wherein the board connection portion of the L-shaped plate terminal is inserted into the insert portion; and engagement portions provided at each of the insert portion and the board connection portion for positioning and fixation of the board connection portion.

2. The fixation structure according to claim 1, wherein the engagement portions provided at the board connection portion are formed into a projection projecting from both sides of the board connection portion, and wherein the engagement portions provided at the insert portion are formed into a U-like shape to surround the projections of the engagement portions of the board connection portion.

3. The fixation structure according to claim 1, wherein the L-shaped plate terminal includes a mating-terminal connection portion extending in a direction parallel to the circuit and continuous with the board connection portion via a bent portion, and wherein anchoring portions are provided respectively at a proximal end of the mating-terminal connection portion of the L-shaped plate terminal and at the terminal fixation portion of the insulating member to fix the proximal end of the mating-terminal connection portion of the L-shaped plate terminal to the terminal fixation portion of the insulating member.

4. The fixation structure according to claim 2, wherein the L-shaped plate terminal includes a mating-terminal connection portion extending in a direction parallel to the circuit board and continuous with the board connection portion via a bent portion, and wherein anchoring portions are provided respectively at a proximal end of the mating-terminal connection portion of the L-shaped plate terminal and at the terminal fixation portion of the insulating member to fix the proximal end of the mating-terminal connection portion of the L-shaped plate terminal to the terminal fixation portion of the insulating member.

* * * * *